United States Patent [19]

Chamness

[11] Patent Number: 4,655,449

[45] Date of Patent: Apr. 7, 1987

[54] RACKET HAVING A GRIP MEMBER SPACED FROM THE HANDLE

[76] Inventor: Terrance H. Chamness, 7979 Westheimer, Y535, Houston, Tex. 77063

[21] Appl. No.: 772,014

[22] Filed: Sep. 3, 1985

Related U.S. Application Data

[63] Continuation-in-part of Ser. No. 579,770, Feb. 13, 1984, abandoned.

[51] Int. Cl.[4] ..... A63B 49/08

[52] U.S. Cl. ..... 273/73 J

[58] Field of Search ..... 273/75, 73 J, 81 R, 273/80 B, 165, 81.4, 72 R, 72 A, 26 B, 29 A; 74/551.9; 81/22, 489

[56] References Cited

U.S. PATENT DOCUMENTS

| | | | |
|---|---|---|---|
| 886,889 | 5/1908 | Stokes | 273/81 R X |
| 1,541,829 | 6/1925 | Larned | 273/73 J |
| 1,853,294 | 4/1932 | Barnhart | 273/80 B X |
| 2,099,319 | 11/1937 | Shaw | 273/81 R |
| 3,664,668 | 5/1972 | Held | 273/75 X |
| 3,879,036 | 4/1975 | Portz et al. | 273/73 J |
| 4,082,273 | 4/1978 | Ellzey | 273/73 J |
| 4,226,418 | 10/1980 | Balfour | 273/75 |
| 4,399,993 | 8/1983 | Melin | 273/75 X |

FOREIGN PATENT DOCUMENTS

| | | | |
|---|---|---|---|
| 128601 | 8/1948 | Australia | 273/73 J |
| 2445877 | 4/1976 | Fed. Rep. of Germany | 273/75 |
| 2149311 | 2/1985 | United Kingdom | 273/73 J |

OTHER PUBLICATIONS

The Sporting Goods Dealer; Borg Racket; 5-1975; p. 156.

*Primary Examiner*—Richard C. Pinkham
*Assistant Examiner*—Matthew L. Schneider
*Attorney, Agent, or Firm*—Matthews & Associates

[57] ABSTRACT

Improved tennis racket including a head, a handle, and a two hand hollow elongated grip member. The head is strung with elastic strings installed within a selected range of tension to provide a selected coefficient of restitution. The handle has a flexure section of selected length and of selected stiffness extending from the head to the grip member. Recovery characteristics and stiffness are selected to provide a desired coefficient of restitution and playability for a designated style of racket. The grip member has an inner end, an outer end, and a first longitudinal opening extending from the outer end and terminating at a selected distance to receive a portion of the handle. A second larger opening extends inwardly from the outer end and adjoins the first recess to define an annular cavity around a portion of the flexure section and an outer periphery of selected length along the grip member.

19 Claims, 7 Drawing Figures

RACKET HAVING A GRIP MEMBER SPACED FROM THE HANDLE

CROSS-REFERENCE WITH OTHER APPLICATIONS

This Application is a continuation-in-part of application Ser. No. 579,770, filed Feb. 13, 1984, for Hand Grip For Tennis Rackets, now abandoned.

FIELD OF THE INVENTION

This invention generally pertains to tennis rackets and more particularly to a tennis racket including a hand grip having an extended elongated hollow gripping surface whereby the player may grip the racket with both hands without deadening the playability of the racket as normally is encountered when a conventional racket is played with use of both hands.

BACKGROUND OF THE INVENTION INCLUDING PRIOR ART

It is common in games which require the use of rackets, such as tennis, for the player to use both hands when making forehand and backhand shots. This allows the player to control the racket head, attitude and velocity. When using both hands, the second hand placement has a detrimental effect on the normal flexing characteristics, performance and playability of the racket because the second hand, while absorbing shock and vibration, also dampens the flexing action desired to produce, in coordination with the recovery characteristics provided by the strings of the racket, optimum playability of the racket.

THE PRIOR ART

The presently known patents which may be pertinent or relative to the present invention are as follows:

Hollis, U.S. Pat. No. 3,674,267 discloses interchangeable grips for a racket of different diameters for various hand sizes.

Galich, U.S. Pat. No. 3,702,189 discloses a racket with a hollow core extending handle portion.

Dean, U.S. Pat. No. 3,833,219 discloses a racket with means to adjust handle grip size and weight which are coordinated for a particular player.

Strickland, U.S. Pat. No. 4,149,721 discloses a replaceable grip interchangeable with grips of various size.

Head, U.S. Pat. No. 3,999,756 discloses a racket having a zone of higher coefficient of restitution and a power zone much larger than that of conventional rackets.

Melin, U.S. Pat. No. 4,399,993 discloses a racket having a hand grip longer and of smaller diameter than usual to accomodate a two handed grip.

Stokes, U.S. Pat. No. 8,886,889 discloses a bicycle handle bar grip having resilient extensions extending from each handle bar.

Larned, U.S. Pat. No. 1,541,829 discloses a game racket having a handle formed of two tubular metal extensions from the racket head.

Held, U.S. Pat. No. 3,664,668 discloses a game racket having a tubular frame forming a handle and a metal head.

Shaw, U.S. Pat. No. 2,099,319 discloses a handle for shafts of percussive or swinging implements wherein a portion of the handle extends over the shaft to reduce jarring impulses to the hands of the wielder.

Balfour, U.S. Pat. No. 4,226,418 includes a handle having finger holes extending laterally from a racket handle to engage the fingers of the player.

German No. 2,445,877, issued 9/26/74, discloses a resilient sleeve handle molded to the shape of the users hand.

Australian No. 128,601, dated Aug. 2, 1948, discloses a sheet type durable grip comprising a flexible split sleeve.

A Borg Racket paper from the *Sporting Goods Dealer,* May, 1975, discloses an extended grip to allow for a two handed backhand.

None of the prior art in general, and none of these patents in particular, discloses the present tennis racket with a hand grip for the handle as provided herein.

OBJECTS OF THE INVENTION

An object of this invention is to provide a hand grip for tennis rackets having an annular extension area which does not absorb shock and vibration so that the hand grip has the playability of a one handed grip as common in tennis rackets.

Another object of this invention is to provide a hand grip for tennis rackets having an extension which may be gripped with either one or two hands, such as when delivering forehand and backhand shots, without affecting the normal flexing characteristics or performance of the racket.

Another object of this invention is to provide a handgrip for tennis rackets whereby the player may have the advantage of using his second hand to control racket head attitude and velocity without the disadvantage of damping the flexing action of the handle portion by the second hand.

Another object of this invention is to provide a tennis racket having a hand grip with an adjustable portion wherein the absorption level of shock and vibration is selectable.

SUMMARY OF THE INVENTION

The tennis racket of the present invention includes a head attached to a handle, and a two hand hollow elongated grip member also attached to the handle. The head is strung with elastic strings installed within a selected range of tension to provide selected recovery characteristics. The handle has a flexure section of selected length and of selected stiffness extending from the head to the grip member. The recovery characteristics of the strings and the stiffness of the flexure section are selected to provide the desired coefficient of restitution and improved playability for a designated style of the racket. The grip member has an inner end, an outer end, and a first longitudinal opening extending from the outer end toward the inner end and terminating at a selected distance to receive a portion of the handle into rigid relative connection. The remaining length of the handle between the connection and the head includes the flexure section. A second circumferentially larger longitudinal opening extends inwardly and adjoining the first recess to define an annular cavity around a portion of the flexure section and an outer periphery of selected length along the grip member whereby the grip member is provided of length to accomodate two handed use of the tennis racket while retaining the playability.

As used herein, a "coefficient of restitution" means the ratio of the outgoing velocity of the ball to the incoming velocity of the ball where both velocities are taken relative to the racket.

DESCRIPTION OF THE PREFERRED EMBODIMENTS

Figure 1:
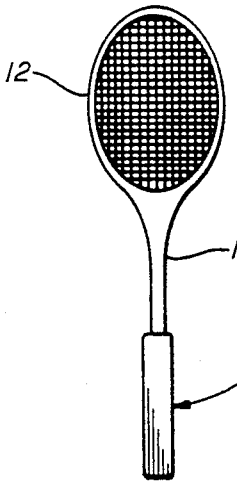
FIG. 1 is a front elevational view of the tennis racket having a hand grip in accordance with the present invention.
Figure 1A:
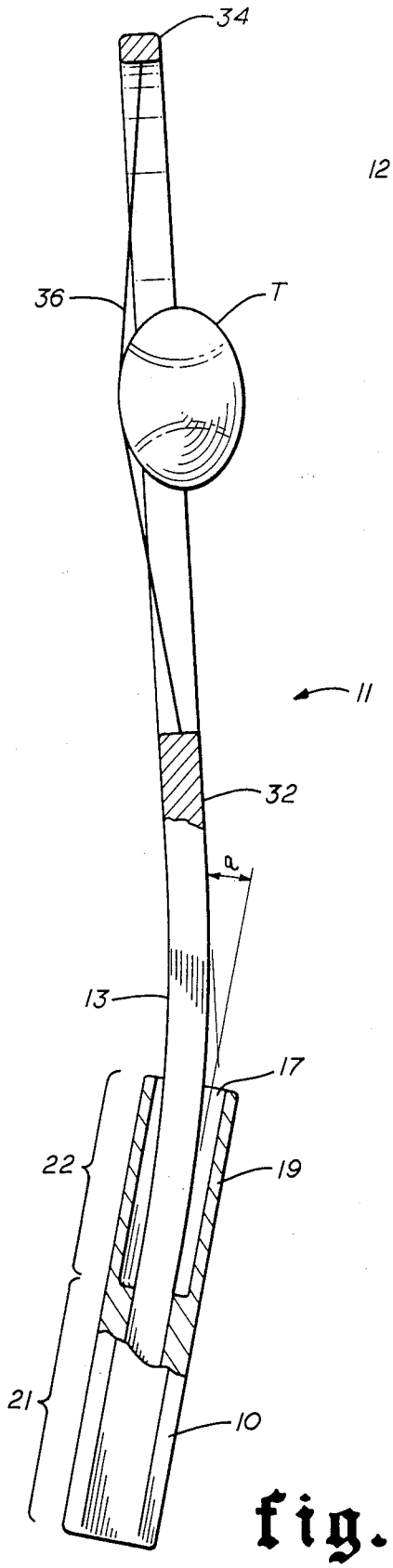
FIG. 1*a* is a side elevational view of the tennis racket of FIG. 1 showing a much exaggerated flexing of the handle and the tennis strings during impact of a tennis ball met by the swing of the tennis racket.
Figure 1B:
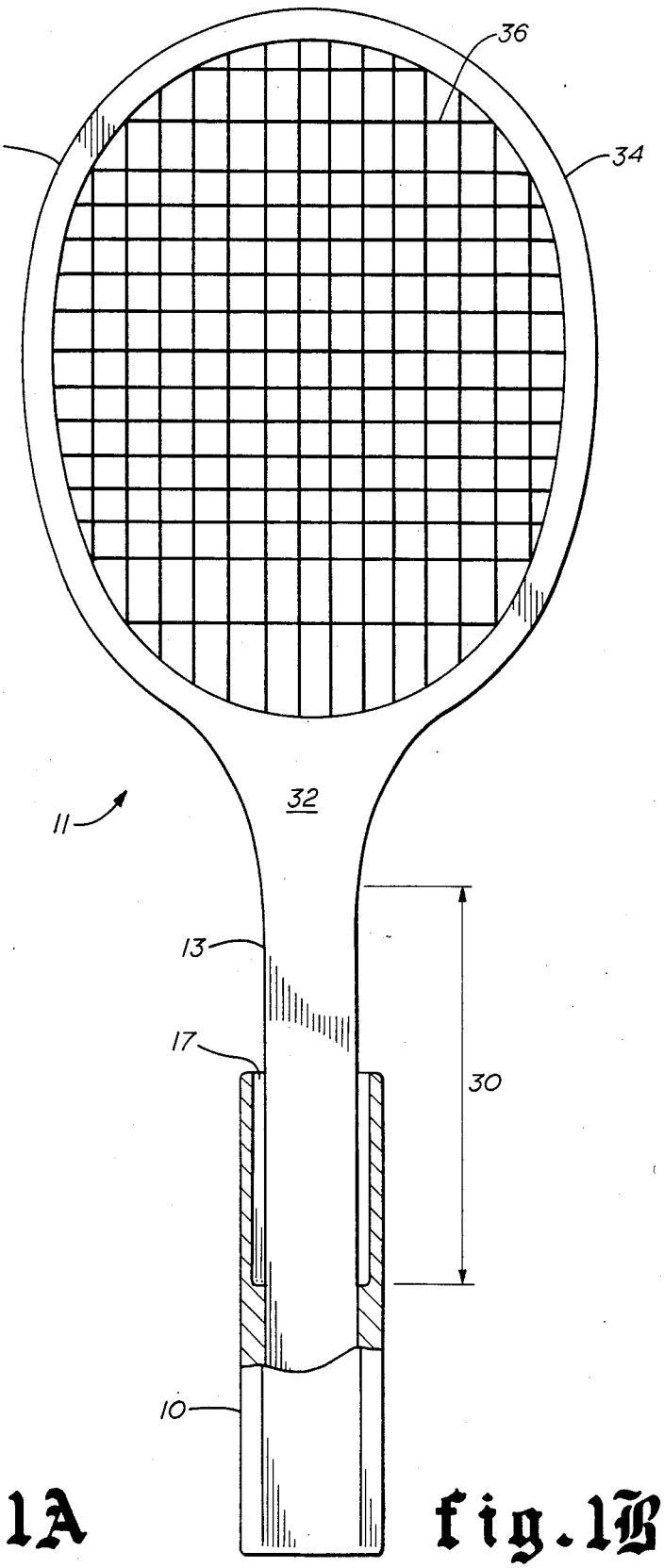
FIG. 1*b* is an enlarged front elevational view of the tennis racket of FIG. 1 showing more structural detail to illustrate the flexing action of the racket as illustrated in FIG. 1*a*.

Referring now to FIG. 1 and FIG. 1*b* there is shown generally a handgrip 10 installed on a tennis racket 11 having a head portion 12 and a handle portion 13 of conventional design and construction. The handle portion 13 has a flexure section 30 extending into the grip 10 as later illustrated. The handle portion 13 merges into a throat section 32 and a frame 34 of the head 12. Strings 36 are strung across frame 34 to complete the tennis racket head in conventional fashion and with a preselected elasticity and tension.

The elasticity of the strings is determined largely by the materials utilized. Animal gut and synthetic materials such as nylon are in predominant use. The tension may be in the order of 40 to 85 pounds, for example.

The "recovery characteristics" of the strings include the string tension and of the string elasticity.

The flexibility of the flexure section 30 is a large factor in the "stiffness" of the racket. The smaller the deflection, the greater the stiffness and vice versa. However, even when the section 30 is relatively stiff, there still must be the flexibility over a given length which is not dampened by the second hand of the player.

The flexure section 30 is accordingly coordinated with the recovery characteristics of the strings to give optimum performance or playability.

Figure 2:
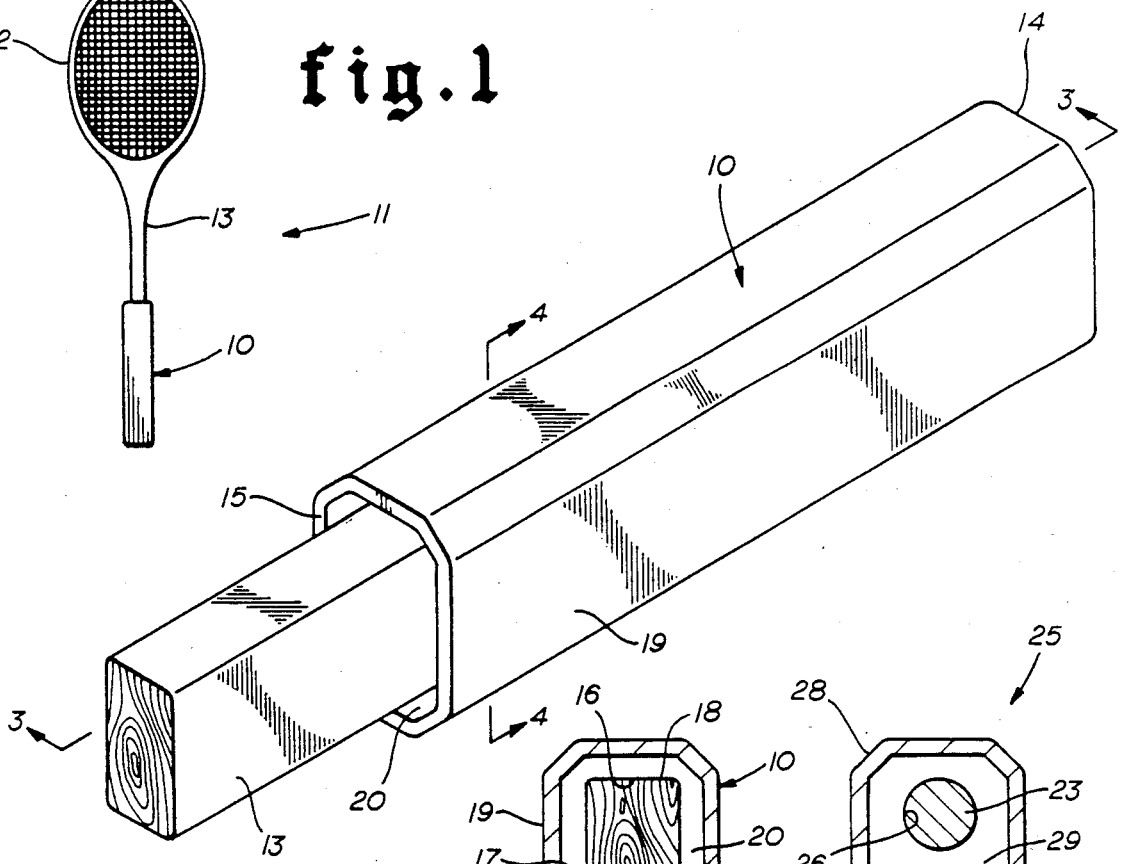
FIG. 2 is an isometric view of a portion of the racket handle and new hand grip of FIG. 1.
Figure 4:
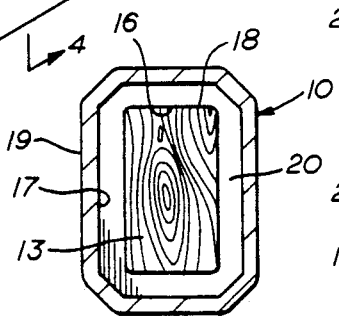
FIG. 4 is a vertical cross-sectional view of the handle portion of a tennis racket taken along line 4—4 of FIG. 2.
Figure 3:
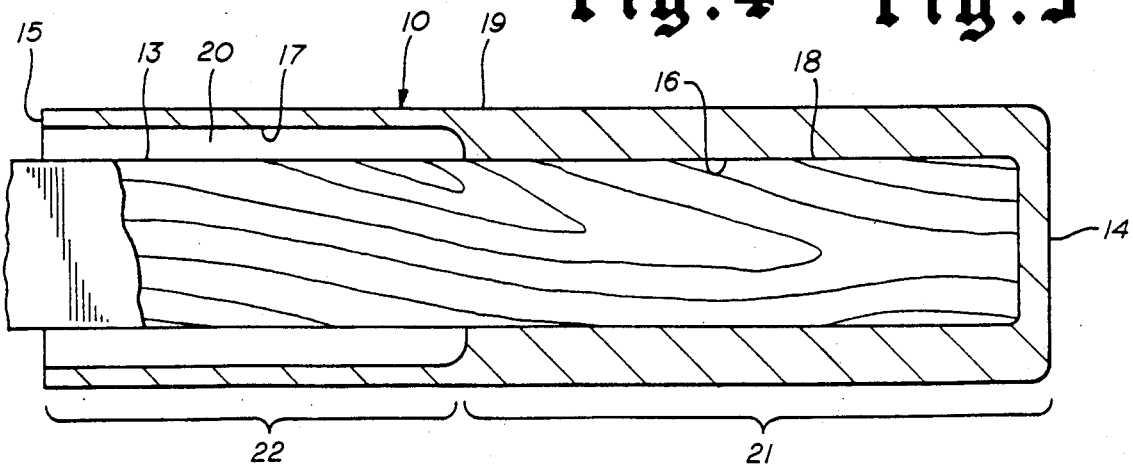
FIG. 3 is a longitudinal cross-sectional view of the handle portion of a racket taken along the line 3—3 of FIG. 2.

FIGS. 2, 3 and 4 show the hand grip 10 in more detail. The handle portion 13 of the conventional racket 11 is, in the case of wooden rackets and the like, of generally rectangular cross-sectional shape, though other shapes are used on occasion.

As shown, the hand grip 10 is a longitudinally elongated hollow octagonal member of rigid material having one optionally enclosed outer end 14, and opposing open inner end 15. A first central longitudinal recess 16 extends from the outer end 14 toward the open inner end 15 and terminates at a distance from the inner end into a second concentric peripherally larger recess 17. The inner surface of the recess 16 fits securely over the outer surface 18 of the bottom of the handle portion 13. The flexure section 30 of the handle 13 begins at the end of the recess 16 and extends through the recess 17 to throat section 32.

A suitable adhesive may optionally be applied between the outer surface 18 and the handle portion 13 to further secure the hand grip 10 against movement.

The outer periphery 19 of the grip 10 is of peripheral size and shape corresponding to the symmetry of conventional racket grips. When the hand grip 10 is secured to the handle 13, the larger recess 17 forms an annular cavity 20 between the flexure section 30 of the handle 13 and the outer periphery of the extended end of the hand grip 10.

The first recess 16 secured to the handle 13 is of suitable length to form a generally a first hand region 21 on the hand grip 10 to be gripped by one hand of the player in the conventional manner. The larger recess 17 is of suitable length to form generally a second hand region 22 on the hand grip 10 to be gripped the player's other hand when making two handed forehand or backhand shots.

FIG. 1*a* shows, in exaggerated fashion, the dynamic condition of the racket 11 at the instants of maximum deflection of each of the strings 36, the flexure section 30 and the ball T when the rapidly moving tennis ball T is being met by a forceful swing of the racket. The flexure section 30 is deflected an amount represented by a deflection angle a and the strings 36 are deflected and stretched as represented. The ball T is deflected into an oblate shape as represented. Following the instants illustrated, the flexure section 30, the strings 36, and the tennis ball T each begins to recover to its original shape at the same time that the swing of the racket continues. All these are factors which contribute to the velocity of the ball T on its return.

It can readily be seen that the behavior of the racket 11 will be the same whether the designated force applied in the swing of the racket is applied by the player with one hand or both hands. In contrast, the flexure section of a conventional racket is dampened by the player's second hand as when making two handed shots.

Figure 5:
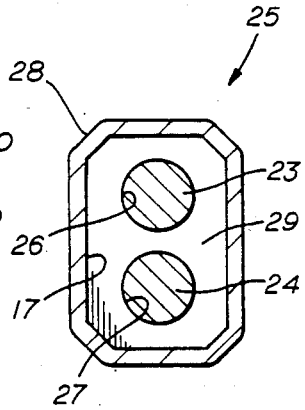
FIG. 5 is a vertical cross-sectional view of the handle portion of another style of racket having an alternate hand grip of the present invention.

FIG. 5 shows an embodiment of a metal racket having a handle portion comprised of two generally parallel round metal shafts 23 and 24. In this alternate embodiment, the hand grip 25 is generally the same configuration as previously described for the hand grip 10 with like parts having the same number except that the first central longitudinal recess is replaced by a pair of generally parallel longitudinal holes 26 and 27 extending from the angular cavity 20 and terminating at or near the distal end. The metal shafts 23 and 24 are secured in the holes 26 and 27 in the same manner as previously described and a suitable adhesive may be applied optionally to the shafts 23 and 24 to further secure the grip 25 against slippage or movement.

The outer periphery of the grip 25 is of circumferential shape and size corresponding in symmetry to conventional metal racket grips. When the hand grip 25 is secured to the shafts 23 and 24, the larger recess 17 forms an annular cavity 20 between the shafts 24 and 23 and the flexure section (not shown) of the extended end of the hand grip 25. Additional support material may be provided between the shafts 23 and 24 to provide additional strength.

The dampening or shock and vibration absorbing characteristics of the hand grip may be altered by varying the length of the cavity portion 20 along with the length of the flexure section 30.

While this invention has been described fully and completely with special emphasis on a preferred embodiment it should be understood that the invention may be practiced otherwise as come within the scope of the appended claims.

I claim:

1. An improved tennis racket comprising:

(a) a head attached to a handle, and a two hand hollow elongated grip member also attached to said handle;

(b) said head being strung with elastic strings installed within a selected range of tension to provide selected recovery characteristics;

(c) said handle having a flexure section of selected length and of selected stiffness extending from said head to said grip member;

(d) the co-action of said recovery characteristics from said strings and said stiffness of said flexure section being selected to provide a desired coefficient of restitution and improved playability of a designated style of said racket with said two hand elongated grip member;

(e) said grip member having an inner end, an outer end, and a first longitudinal opening extending from said outer end toward said inner end and terminating at a selected distance to receive a portion of said handle such that said grip member is rigidly connected to said handle;

(f) the remaining length of said handle between said connection and said head including said flexure section; and (g) a second longitudinal opening peripherally larger than said first longitudinal opening and extending from the termination of said first opening towards said inner end so as to define an annular cavity between said grip member and said handle such that said grip member and said handle do not contact each other.

2. The tennis racket of claim 1 wherein said handle portion is secured in said first opening by provision of adhesive material between the contiguous surfaces of said first recess and said handle.

3. The tennis racket of claim 1 wherein the outer periphery of said tennis racket is of peripheral size and shape corresponding to conventional racket grips.

4. The tennis racket of claim 1 wherein the portion of said grip member about said first opening is of suitable length to form a first hand gripping portion to be gripped by one hand of a player in the conventional manner.

5. The tennis racket of claim 1 wherein the portion of said grip member about said second larger opening is of suitable length to form a seond hand gripping portion to be gripped by the other hand of the player when making two handed shots.

6. The tennis racket of claim 1 wherein the length of said flexure section between said racket head and said first opening is provided of designated length to provide a selected playability of said tennis racket.

7. The tennis racket of claim 1 wherein said strings are provided of designated tension to provide a selected playability of said racket.

8. The tennis racket of claim 1 wherein said first longitudinal opening is provided as a pair of parallel holes and said handle is provided as a pair of parallel shaft members.

9. The tennis racket of claim 8 wherein said handle portion is secured in said first opening by provision of adhesive material between the contiguous surfaces of said first opening and said shaft members.

10. The tennis racket of claim 8 wherein the outer periphery of said tennis racket is of peripheral size and shape corresponding to conventional racket grips.

11. The tennis racket of claim 8 wherein the portion of said grip member about said first opening is of suitable length to form a first hand gripping portion to be gripped by one hand of the player in the conventional manner.

12. The tennis racket of claim 8 wherein the portion of said grip member about said second larger opening is of suitable length to form a second hand gripping portion to be gripped by the other hand of the player when making two handed shots.

13. The tennis racket of claim 8 wherein the remaining length of said handle between said racket head and said first opening is of designated length to provide a selected playability of said racket.

14. The racket of claim 8 wherein said strings are of designated tension to provide a selected playability of said racket.

15. The racket of claim 1 wherein said head is adapted to be strung with elastic strings installed within a selected range of tension to provide selected recovery characteristics.

16. An improved tennis racket comprising:

(a) a head attached to a handle, and a hollow elongated two hand grip member also attached to said handle;

(b) said head being strung with designated elastic strings installed within a designated range of tension;

(c) said handle having a flexure section of designated length and of designated stiffness extending from said head to said grip member;

(d) the co-action of the recovery characteristics of said strings and said designated length and stiffness of said flexure section being selected to provide a designated playability for a designated style of said racket with said two handed grip member;

(e) said grip member having an inner end, an outer end, and a first longitudinal opening extending from said outer end toward said inner end and terminating at a designated distance to receive a portion of said handle such that said grip member is rigidly connected to said handle;

(f) said first longitudinal opening being provided as a pair of parallel holes and said handle being provided as a pair of parallel shaft members;

(g) the remaining length of said handle between said connection and said head including said flexure section;

(h) a second longitudinal opening peripherally larger than said first longitudinal opening and extending from the termination of said first opening towards said inner end so as to define an annular cavity between said grip member and said handle such that said grip member and said handle do not contact each other.

17. The tennis racket of claim 16 wherein the length of said handle between said racket head and said first opening is of designated length to provide selected playability of said racket.

18. The racket of claim 17 wherein said strings are of designated tension to provide selected playability of said racket.

19. An improved tennis racket comprising:

(a) a head attached to a handle, and a hollow elongated two hand grip member also attached to said handle;

(b) said grip member having an inner end, an outer end, and a first longitudinal opening extending from said outer end toward said inner end and terminating at a selected distance to receive a portion of said handle such that said grip member is rigidly connected to said handle;

(c) the remaining length of said handle between said connection and said head defining a flexure section;

(d) a second longitudinal opening peripherally larger than said first longitudinal opening and extending from the termination of said first opening towards said inner end so as to define an annular cavity around and along a portion of said flexure section such that said grip member does not contact said handle.

* * * * *